United States Patent [19]

Crotty

[11] Patent Number: 4,578,122

[45] Date of Patent: Mar. 25, 1986

[54] NON-PEROXIDE TRIVALENT CHROMIUM PASSIVATE COMPOSITION AND PROCESS

[75] Inventor: David E. Crotty, Highland Park, Mich.

[73] Assignee: OMI International Corporation, Warren, Mich.

[21] Appl. No.: 670,384

[22] Filed: Nov. 14, 1984

[51] Int. Cl.[4] ..... C23F 7/26

[52] U.S. Cl. ..... 148/6.2

[58] Field of Search ..... 148/62

[56] References Cited

U.S. PATENT DOCUMENTS 3,932,198 1/1976 Schneider ..... 148/6.2

4,359,345 11/1982 Fonte ..... 148/6.2

*Primary Examiner*—Sam Silverberg

*Attorney, Agent, or Firm*—Richard P. Mueller

[57] ABSTRACT

An aqueous acidic peroxide-free solution and process for treating receptive metal surfaces to impart a chromium passivate film thereon containing chromium ions substantially all of which are present in the trivalent state, hydrogen ions to provide a pH of about 1.2 to about 2.5, at least one additional metal ion selected from the group consisting of iron, cobalt, nickel, molybdenum, manganese, aluminum, lanthanum, cerium, lanthanide mixtures as well as mixtures thereof present in an amount effective to activate the formation of the chromate passivate film and nitrate ions as the essential oxidizing agent present in an amount to provide a mol ratio of nitrate ions to chromion ions and activating metal ions of at least about 4:1 and sufficient to activate the hydrated trivalent chromium to form a chromate film on the substrate. The aqueous acidic solution can optionally, and preferably further contain controlled amount of sulfate ions, halide ions, organic carboxylic acids, a bath soluble and compatible silicate compound, and one or a combination of wetting agents to further enhance the characteristics of the passivate film produced.

20 Claims, No Drawings

NON-PEROXIDE TRIVALENT CHROMIUM PASSIVATE COMPOSITION AND PROCESS

BACKGROUND OF THE INVENTION

Aqueous acidic chromium passivating solutions are in widespread commercial use for improving the corrosion resistance and for enhancing the appearance of various receptive metal surfaces including zinc, zinc alloy, cadmium, cadmium alloy surfaces and the like. Such passivating solutions can be controlled to impart a yellow or a blue-bright coating to the surface in which the latter simulates a chromium finish.

Such chromium passivate solutions conventionally contained chromium ions in the hexavalent state but in more recent years have been replaced by trivalent chromium ions in view of the increased simplicity and efficiency in treating waste effluents containing chromium in the trivalent state. While initially, trivalent chromium passivate solutions were less effective than the conventional hexavalent chromium passivating compositions, further research and development has now produced trivalent chromium passivate compositions which provide for acceptable passivate films on a variety of receptive metal substrates. Typical of such processes are those described in U.S. Pat. Nos. 4,359,345; 4,359,346; 4,359,347; 4,359,348; 4,349,392; and 4,367,099 which are all assigned to the assignee of the present invention and the teachings of which are incorporated herein by reference to the extent that the disclosures contained therein are relevant to the subject matter of the present invention. Typical other prior art compositions and processes for treating zinc and zinc alloy surfaces are those such as disclosed in U.S. Pat. Nos. 2,393,663; 2,559,878; 3,090,710; 3,553,034; 3,755,018; 3,795,549; 3,843,430; 3,880,772; 3,932,198; 4,126,490; 4,171,231; 4,263,059; British Pat. No. 586,517 and No. 1,461,244; and German Pat. No. 2,526,832.

Chromium passivate compositions of the types commercially employed and as described in the aforementioned patents invariably employ peroxide-type oxidizing agents, particularly hydrogen peroxide, which is a necessary bath constituent to produce acceptable passivate films. A continuing problem associated with such peroxide-type passivating compositions is the high rate of consumption and relatively rapid loss of the peroxide oxidizing agent necessitating frequent replenishment and a further careful control of pH by adjustment due to the relatively rapid rise in pH. The consumption of peroxide is due in part to the presence of various activating metal ions present in the solution as well as contaminating metal ions such as zinc, cadmium and iron, for example, which are introduced by the dissolution of the metal from the substrates being treated which tend to catalyze a decomposition of the oxidizing agent. The frequent replenishment of the hydrogen peroxide is not only time consuming but is also relatively costly. Such depletion of the peroxide oxidizing agent also occurs when the bath stands overnight and over weekends between operating shifts.

The advent of high-speed treatment of metal surfaces such as zinc, for example, in which the aqueous acidic chromium passivating solution is spray applied to the metal surface for short periods of time such as 1 to 10 seconds has further aggravated the problem due to the increased loss of the peroxide constituent in such spray applications and the volatilization and contamination of the surrounding atmosphere providing an environmentally objectionable working condition. High-speed immersion type applications in which jets of the passivate solution are directed against the surface to be treated also result in an excessive loss of the peroxide-type oxidizing agent.

It has also been observed in the processing of work pieces incorporating apertures which have not received a coating or plating of metal such zinc, for example, of which metal tubing is typical, an immersion of such tubing into a peroxide-type chromium passivate solution causes a rapid flash-rusting of the interior of the tubing in a matter of only several seconds causing rust spots and further causing an excessive consumption of the peroxide oxidizing agent during its reaction with the exposed ferrous metal on the interior of the tubing.

The present invention overcomes many of the disadvantages and problems associated with prior art trivalent-type chromium passivating solutions employing an alternative non-peroxide oxidizing agent which is of relatively low volatility, is inexpensive, does not form environmentally objectionable vapors, can be employed in high-speed passivating processes without objectionable loss of the oxidizing agent, can be employed for passivating work pieces having exposed bare iron or steel surfaces such as tubing wherein the solution itself serves to passivate rather than flash oxidize such bare surfaces, and wherein the composition and the process of use of the composition is of simple and economical operation and control.

SUMMARY OF THE INVENTION

The benefits and advantages of the present invention are achieved in accordance with the composition aspects thereof by an aqueous acidic chromium passivating solution comprising chromium ions substantially all of which are present in the trivalent state at a concentration ranging from about 0.05 grams per liter (g/l) up to saturation, hydrogen ions to provide an operating solution pH of about 1.2 to about 2.5, nitrate ions as the essential oxidizing agent present in a controlled molar excess relative to the molar concentration of the chromium ions and other activating metal ions present in the solution so as to be effective to activate the hydrated trivalent chromium to form a chromate passivate film on the metal substrate being treated, and at least one additional activating metal ion selected from the group consisting of iron, cobalt, nickel, molybdenum, manganese, aluminum, lanthanum, cerium and lanthanide mixtures, as well as mixtures thereof present in an amount effective to activate the bath and formation of a chromium passivate film of the desired appearance on the substrate treated. The solution may optionally, and preferably, contain halide ions for imparting additional hardness to the coating, a bath soluble and compatible silicate compound present in an amount effective to impart increased corrosion resistance and hardness to the passivate film, a bath soluble and compatible organic carboxylic acid present in an amount effective to impart initial hardness and clarity to the passivate film as well as a wetting agent such as Blancol N from GAF Corporation comprising a condensate of an alkyl naphthalene sulfonate and formaldehyde. In addition, Dequest 2010, a phosphonate from Monsanto, has been found advantageous for effecting charification of the film when an aged bath has become contaminated with appreciable quantities of iron and zinc ions.

In accordance with the process aspects of the present invention, a receptive metal substrate is contacted with an aqueous acidic treating solution of the foregoing composition, at a temperature ranging from about 40° to about 150° F., preferably from about 70° to about 90° F. for a period of time typically ranging from as little as 1 second up to about 1 minute or longer to form the desired passivate coating thereon. The passivated substrate can be directly dried after extraction from the bath or, optionally, can be subjected to a final rinse, preferably after an intervening water rinse, in a dilute aqueous silicate solution usually at a temperature of about 50° to about 150° for a period of time usually ranging from about 1 second up to about 1 minute or more in order to further enhance the properties of the film whereafter the surfaces are air dried.

Additional benefits and advantages of the present invention will become apparent upon a reading of the Description of the Preferred Embodiments taken in conjunction with the specific examples provided.

DESCRIPTION OF THE PREFERRED EMBODIMENTS

The present invention is particularly applicable, but not necessarily restricted to the treatment of cyanide and alkaline and acidic non-cyanide zinc electrodeposits to impart improved corrosion resistance and a decorative appearance to the treated substrate. Particularly satisfactory results are obtained on decorative zinc electrodeposits of a bright and semi-bright type although beneficial effects are also attained on zinc and zinc alloy substrates such as galvanized substrates, zinc die castings and substrates comprised of cadmium or alloys of cadmium consisting predominantly of cadmium. It has also been observed that beneficial results are also obtained in the treatment of aluminum, aluminum aaloy, magnesium and magnesium alloy surfaces to form a passivate film or coating thereon. Beneficial results have also been observed in the treatment of work pieces having exposed ferrous surfaces such as steel, for example, in which a passivation of such exposed surfaces is also attained simultaneously with the treatment of the coated or plated surfaces such as zinc. Accordingly, the present invention in its broad sense is directed to the treatment of metal surfaces which are receptive to the formation of a passivate film thereon when contacted with the aqueous acidic solution of the present invention applied in accordance with the process parameters hereinafter disclosed.

The treating solution in accordance with the composition aspects of the present invention contains as its essential constituents, chromium ions which are present substantially all in the trivalent state, hydrogen ions to provide a pH of from about 1.2 to about 2.5, nitrate ions as the essential oxidizing agent present in a controlled molar excess relative to the molar concentration of the chromium ions and other activating metal ions present in the solution so as to be effective to activate the hydrated trivalent chromium to form a chromate film on the metal surface being treated, at least one additional activating metal ion selected from the group consisting of iron, cobalt, nickel, molybdenum, manganese, aluminum, lanthanum, cerium and lanthanide mixtures of rare earth metals as well as mixtures thereof present in an amount effective to impart integral hardness to the gelatinous chromate film and optionally, but preferably, sulfate ions, halide ions, one or more compatible wetting agents, a bath soluble and compatible silicate compound, as well as bath soluble and compatible organic carboxylic acids as a hardness imparter.

The trivalent chromium ions can be introduced in the form of any bath soluble and compatible salt such as chromium sulfate, $Cr_2(SO_4)_3$, chromium alum [$KCr(SO_4)_2$], chromium chloride [$CrCl_3$], chromium bromide [$CrBr_3$], chromium fluoride [$CrF_3$], chromium nitrate $Cr(NO_3)_3$, or the like. The trivalent chromium ions can also be introduced by a reduction of a solution containing hexavalent chromium ions preferably using sulfur dioxide or bisulfite providing a mixture of trivalent chromium ions and sulfate compounds. A material of the foregoing type which has been found particularly satisfactory for use in accordance with the practice of the present invention is Chrometan available from British Chromium.

The concentration of the trivalent chromium ions in the treating solution may range from as low as about 0.05 g/l up to saturation, with concentrations of about 0.2 to about 4 g/l being preferred. Typically, the operating bath contains from about 0.5 to about 2 g/l trivalent chromium ions.

The treating bath contains hydrogen ions in a concentration to provide a pH of about 1.2 to about 2.5 with a pH range of about 1.5 to about 1.8 being preferred for producing clear to light-blue passivate films. Acidification of the operating bath to within the desired pH range can be achieved by a variety of mineral acids and organic acids such as hydrochloric acid, formic acid, acetic acid, propionic acid, and the like. Preferably, pH adjustment is effected by employing nitric acid and/or sulfuric acid which simultaneously introduces the desirable nitrate ions and sulfate ions in the operating bath. It has been observed that the presence of sulfate ions in the bath is beneficial in achieving the desired passivation of the substrate and is included in the bath by the addition of sulfuric acid and/or alkali metal and ammonium sulfate salts as well as metal salts of the other bath constituents. Generally, sulfate ion concentrations ranging up to about 15 g/l can be employed with amounts of about 0.5 to about 5 g/l being preferred.

A further essential ingredient of the bath comprises nitrate ions as the principal oxidizing agent which can be introduced in the form of nitric acid, alkali metal and ammonium salts as well as salts of the metal ions present in the bath. Supplemental oxidizing agents can be incorporated in minor amounts if desired although nitrate ions by themselves are preferred. The concentration of nitrate ions is controlled relative to the concentration of chromium ions and other activating metal ions in the bath so as to provide a mol ratio of nitrate ions to the sum of chromium and activating metal ions within a range of about 4:1 to about 100:1 or higher, ($NO_3$:metal ions), typically about 10:1 to about 40:1, and especially about 15:1 to about 30:1. At mol ratios below about 40:1, the formation of an integral passivate film of the requisite thickness proceeds at commercially unsatisfactory rates rendering such compositions impractical for most commercial applications and/or producing passivate films which do not provide the requisite corrosion protection. The particular mol ratio of nitrate ions to chromium and activating metal ions within the aforementioned operating range will be dictated to some extent by the total concentration of trivalent ions present as well as the other bath constituents in further consideration of the process parameters employed in forming the passivate film. In so-called "high-speed" processes, higher concentrations of the active ingredients are required to effect the formation of an adequate passivate film in relatively short time periods such as as low as 1 second up to about 10 seconds. In contrast, during conventional passivating processes, time periods of about 10 seconds up to about 1 minute or longer can be employed whereby corresponding lower concentrations of the active constituents can be employed.

A further essential constituent in the bath comprises at least one additional activating metal ion selected from the group consisting of iron, cobalt, nickel, molybdenum, manganese, aluminum, lanthanum, cerium, lanthanide mixtures as well as mixtures thereof. The foregoing metal ions or mixtures of metal ions are conveniently introduced into the bath by way of bath soluble and compatible metal salts including the sulfates, nitrates, halide salts, or the like. For economic reasons, the lanthanum ions are introduced not as pure lanthanum compound, but as a mixture of the rare earth salts of the metals of the lanthanide series, (hereinafter designated as "lanthanide mixture") which contains lanthanum compounds as the predominant constituent. A commercially available lanthanide mixture which is suitable for use in the practice of the present invention is Lanthanum—Rare Earth Chloride, Product Code 5240, available from Molycorp, Inc. of White Plains, N.Y. This product has the general formula La-$RECl_3(6H_2O)$ and is available as a solution containing about 55 to 60 percent by weight solids. The solution is prepared from a rare earth oxide (REO) concentrate containing a minimum of 46 percent by weight total REO comprising about 60 percent lanthanum oxide ($La_2O_3$), 21.5 percent neodymium oxide ($Nd_2O_3$), 10 percent cerium oxide ($CeO_2$), 7.5 percent praseodymium oxide ($Pr_6O_{11}$) and 1 percent of residual REO. The presence of such other rare earth metals in the solution does not appear to have any adverse effect at the low concentrations in which they are present and may further contribute to the activation of the treating solution in forming the passivate film.

The concentration of the additional activating metal ions is controlled within a range of about 0.02 up to about 1 g/l with concentrations from about 0.1 to about 0.2 g/l being preferred. While such metal ions can be used in concentrations above 1 g/l, such as, up to about 10 g/l, the use of such higher concentrations tends to produce dull films of a yellow tint rather than the desired clear or light-blue films. For this reason, such higher concentrations are usually undesirable from an appearance standpoint.

As a further optional but preferred constituent, the bath contains halide ions including chloride, bromide and fluoride ions which have been found to enhance the hardness of the passivate film on the treated substrate. The halide ions or mixture thereof can conveniently be introduced employing any of the alkali metal and ammonium salts thereof as well as salts of the metal ions hereinabove set forth. The concentration of the total halide constituent in the bath normally may range up to about 2 g/l with concentrations of about 0.1 to about 0.5 g/l being typical.

Optionally, but preferably, the operating bath may contain an organic carboxylic acid or salt thereof of the structural formula:

$$(OH)_aR(COOH)_b$$

Wherein:

a is an integer from 0 to 6;

b is an integer from 1 to 3; and

R is an alkyl, alkenyl, or aryl containing from $C_1$ to $C_6$ carbon atoms; as well as the bath soluble and compatible salts thereof.

The bath soluble and compatible carboxylic acid or salt can be present in an amount effective to impart increased clarity and initial hardness to the gelatinous chromate film deposited. The particular concentration or range of concentrations of the clarity-hardness agent, if used, will vary in proportion to molecular weight of the particular acid and/or metal salt employed with higher concentrations required for an equivalent effectiveness as the molecular weight of the additive agent increases. The particular concentration to achieve optimum clarification and hardness is also dictated to some extent by the concentration of the silicate and other metal ions present in the bath with higher concentrations being used as the metal ion concentrations increase. Generally, the organic carboxylic acid additive agent or metal salts thereof can be employed in amounts ranging up to about 4.0 g/l with concentrations of about 0.1 to about 1.0 g/l being typical.

The carboxylic acid and/or salt additive can be introduced as the organic acid itself or as any bath soluble and compatible metal salt including the alkali metal salts, ammonium salts and salts of the several additional metal ions in the bath. For economic reasons, the organic acid is usually introduced as an acid or as the sodium or potassium salt thereof.

Within the scope of the structural formula as hereinabove set forth, organic carboxylic acids which have been found particularly suitable include malonic, maleic, succinic, gluconic, tartaric and citric, of which succinic or succinate salts have been found particularly effective.

The use of controlled amounts up to about 1 g/l of a complexing agent such as 1-hydroxy ethylidene-1,1 diphosphonate (Dequest 2010) has also been found particularly beneficial as a clarifying agent for the passivate film in aged operating baths containing appreciable concentrations of contaminating zinc and iron ions, for example, introduced by the dissolution of zinc and iron surfaces of articles being treated.

An optional but preferred constituent of the treating bath comprises a silicate compound present in an amount effective to provide an improved corrosion protection and hardness to the passivate film formed on the treated substrate. The silicate compound comprises a bath soluble and compatible inorganic or organic silicate compound as well as mixtures thereof which are present in an amount of about 0.01 up to about 5 g/l calculated as $SiO_2$, with concentrations of about 0.1 to about 0.5 g/l being preferred. When inorganic silicates are employed, concentrations above about 2 g/l in the operating bath are undesirable because of the tendency of the silicate to form fine flocculent precipitates with the metal ions present in the bath under the acidic conditions present with contributes toward bath instability. Organic silicates, on the other hand, provide for improved bath stability and are preferred for the formation of make-up and replenishment concentrates because of the improved stability and prolonged shelf life.

Inorganic silicates suitable for use in the practice of the present invention include alkali metal and ammonium silicates of which sodium silicate [$Na_2O(xSiO_2)$ ($x=1-4$] and potassium silicate [$K_2O(ySiO_2)$ ($y=1-5$)] are preferred for economic reasons. Organic silicates which can also be satisfactorily employed include tetramethylammonium silicate, phenyltrimethylammonium silicate, disilicate and trisilicate, and benzyltrimethylammonium silicate and disilicate. Such silicates meeting the purposes of this invention are expressed by the following general formula:

$$ROR':xSiO_2:yH_2O$$

Where R is a quaternary ammonium radical substituted with four organic groups selected from the groups alkyl, alkylene, alkanol, aryl, arkylaryl or mixtures thereof, where R' is either R or hydrogen, where x equals 1 to 3 and where y equals 0 to 15.

Such water soluble organic silicates including their synthesis and characterization is more fully described in literature such as the article by Merrill and Spencer, "Some Quaternary Ammonium Silicates", published in the Journal of Physical and Colloid Chemistry, 55, 187 (1951), the substance of which is incorporated herein by reference. Similar silicates including typical synthesis thereof is disclosed in U.S. Pat. No. 3,993,548 to which reference is also made for further details.

In addition to the foregoing, the use of a small effective amount of a variety of bath compatible wetting agents also provides beneficial results in the nature of the passivate film deposited. When employing the wetting agent can be present in concentrations up to about 1 gram per liter (g/l) with concentrations of about 50 to about 100 mg/l being preferred. Wetting agents suitable for use in the treating bath include aliphatic fluorocarbon sulfonates available from 3M under the Fluorad brandname, such as, for example, Fluorad FC 98, which is a nonfoaming wetting agent and its use at about 100 mg/l in the working path improves the color and hardness of the passivate film. A second class of suitable wetting agents is the sulfo derivatives of succinates. An example of this class is Aerosol MA-80 which is a dihexyl ester of sodium sulfosuccinic acid and is commercially available from American Cyanamid Company. A third class of suitable wetting agents is the sulfonates of naphthalene which are linear alkyl naphthalene sulfonates, such as Petro Ba, for example, available from Petrochemical Company.

Particularly beneficial results are achieved by employing polymeric-type wetting agents such as bath soluble salts of sulfated alkylphenoxy poly(ethylene oxy ethanol) such as Alipal CO433, for example; sulfonated alkyl naphthalene, such as Nekal BX78 as well as bath soluble and compatible salts of sulfonated naphthalene-formaldehyde condensates such as Blancol N.

In accordance with the process aspects of the present invention a trivalent chromium operating bath as hereinbefore described is applied to a substrate by spray, immersion, flooding or the like for a period of time sufficient to form the desired passivate film thereon. The treating solution can be applied at a temperature ranging from about 40° up to about 150° with temperatures ranging from about 70° to about 90° F. being preferred. The contact time of the solution with the substrate can vary from as little as about 1 second to as long as 1 minute or longer. In conventional passivating processes, contact times in which the work is immersed in the aqueous acidic solution can range from about 10 seconds up to about 1 minute in consideration of the thickness of the film required, the amount of cleaning of the substrate required and the speed of production of work pieces. The particular time of contact to achieve the desired passivate film is effected by the pH. Generally, a pH of about 1.5 normally requires about 10 to 20 seconds to prepare a passivate film of satisfactory color and corrosion protection. On the other hand, a pH of about 2.5 requires a contact time of about 35 to about 50 seconds to accomplish a similar film.

In high-speed passivating processes, of the general types employed in the treatment of coil steel, wire and tubing in a continuous process, passivation must be effected in a matter of few seconds in view of the high speed of travel of the work pieces through the passivation section. Typically, contact times of only about 1 up to about 10 seconds are commercially feasible and the aqueous solution is applied by spray or by jets under high velocity as well as by immersion to achieve uniform contact. In view of the shorter time period available, the concentration of the active constituents is increased to achieve a comparable passivate film deposition within the shorter available time period.

At the conclusion of the passivation treatment, the article is extracted and generally is dried such as by warm circulating air. It is also contemplated that the work pieces can be subjected to one or a plurality of water rinses to remove residual passivate solution from the surfaces thereof whereafter the substrates can be further contacted with a dilute post silicate rinse solution which may range from room temperature to an elevated temperature of up to about 150° F. for a period of about 1 second up to about 1 minute or longer. Such dilute silicate rinse solutions contain as their essential constituents, a bath soluble and compatible inorganic or organic silicate compound as well as mixtures thereof of the same type as previously described in connection with those suitable for use in the aqueous acidic passivating bath. The silicate compound can be present in an amount of about 1 up to about 40 g/l with amounts preferably ranging from about 5 to about 15 g/l calculated as $SiO_2$. The post silicate rinsed substrate after removal from the rinse solution can be dried such as by recirculating warm air.

In order to further illustrate the present invention, the following examples are provided. It will be understood that the examples are provided for illustrative purposes and are not intended to be limiting of the scope of the present invention as herein described and as set forth in the subjoined claims.

EXAMPLE 1

A trivalent chromium concentrate designated as "Concentrate A" is prepared by forming an aqueous solution containing 30 g/l trivalent chromium ions introduced as chromium sulfate, 30 g/l citric acid, 90 g/l sodium nitrate, 11 g/l nickel ions introduced as nickel sulfate and 30 g/l of a wetting agent comprising a polymeric alkyl naphthalene sulfonate from GAF designated as Blancol N. A second aqueous concentrate designated as "Concentrate B" is prepared by dissolving 600 g/l of sodium nitrate in water.

The foregoing concentrates are suitable for admixture with water to form operating baths in accordance with the following examples.

EXAMPLE 2

An operating bath suitable for use in the formation of a chromium passivate coating under general operating conditions including contact times ranging from about 10 up to about 60 seconds is prepared by admixing 0.5 to about 3 percent by volume of Concentrate A and about 1 to about 3 percent by volume of Concentrate B in water forming a series of test solutions. At 3 percent by volume concentrate A and 1 percent by volume Concentrate B, the operating bath has a mol ratio of nitrate ions to metal ions (chromium and nickel) of about 5:1. When Concentrates A and B are both employed at 3 percent by volume, the operating bath has a mol ratio of nitrate ions to metal ions of about 11.8:1. The pH of the operating solution is adjusted within a range of about 1.5 to about 2.5 employing nitric acid. The operating bath is contacted with non-cyanide bright acid zinc plated steel test panels at a temperature ranging from 60° to 90° F. employing air agitation or mechanical agitation. Additionally, operating solutions of the foregoing compositions are employed for passivating zinc plated fasteners in barrel plating apparatus, various rack plated zinc plated steel stampings and elongated zinc plated threaded rods under simulated commercial process conditions.

In each instance, the chromium passivate film is clear, hard and deep-blue in appearance.

It will be appreciated that the passivation treatment is normally performed in series following the zinc or other plating operation and the available time for the passivation treatment is determined to a large extent by the machine cycle and process sequence of the parts passing through the plating section of the process. Accordingly, to achieve the desired cleaning of the parts prior to plating, to achieve the desired thickness of the electrodeposit on the part, variations will occur in the available time for the subsequent passivation treatment of the plated parts. This can be accommodated by adjusting the pH of the passivation solution to achieve proper color and corrosion protection within the particular time frame available. For example, when contact times of from about 10 to about 20 seconds are available, the passivating solution is preferably adjusted to a pH of about 1.5. When greater time periods of about 35 to about 50 seconds are available, a pH adjustment to about 2.5 will provide equivalent results.

EXAMPLE 3

An aqueous acidic passivate solution suitable for high-speed applications is prepared by admixing in water about 5 to about 10 percent by volume Concentrate A and about 3 to about 10 percent by volume Concentrate B as described in Example 1. At 5 percent Concentrate A/3 percent Concentrate B, $NO_3$:metal ion mol ratio is about 8.04:1; at 5 percent Concentrate A/10 percent Concentrate B, $NO_3$:metal ion mol ratio is about 23:1; at 10 percent Concentrate A/3 percent Concentrate B, $NO_3$:metal ion mol ratio is about 4.6:1; at 10 percent Concentrate A/10 percent Concentrate B, $NO_3$:metal ion mol ratio is about 11.8. A series of operating baths are prepared and the pH is adjusted with nitric acid between a range of about 1.5 to about 2. The passivating solution is controlled within a temperature of about 70° to about 90° F.

Solutions of the foregoing type are suitable for use under so-called high-speed conditions and are employed in series with processes for electroplating steel coils, strips, wire and tubing in a continuous manner. Under such conditions, contact times of only about 1 to about 10 seconds are available to achieve an appropriate passivation treatment. The passivating solution can be applied by high pressure spray or by immersion of the strip or continuous article in the solution through which it passes rapidly from the inlet end to the outlet end thereof.

Under the foregoing composition and operating parameters, zinc plated work pieces processed under simulated commercial high-speed operations were provided with a hard, clear, blue-bright passivate film.

EXAMPLE 4

An aqueous acidic operating bath is prepared by forming an aqueous solution containing 2 percent by volume of concentrate A and 3 percent by volume of Concentrate B as described in Example 1 which is controlled at a temperature of 75° F. The operating bath had a $NO_3$:metal ion mol ratio of about 16.7:1. The pH of the solution is adjusted at various levels employing nitric acid. Acid zinc plated test panels and work pieces are passivated employing the foregoing solution at different pH levels for different time periods employing conventional immersion processing with air agitation as well as barrel treatment.

The resultant treated articles are subjected to a 5 percent salt spray test to white corrosion. From the foregoing tests, a pH of 1.5 and a treatment time of from about 10 to about 20 seconds is found optimum for treating rack panels as well as barrel plated parts. A pH of about 1.7 to about 2 at a treatment time of about 15 to about 25 seconds is found optimum under the foregoing composition and processing parameters. At a pH of 2 to about 2.5, contact times of about 25 to about 40 seconds provide optimum protection. Panels were subjected to the ASTM B-117-73 5 percent neutral salt spray corrosion test. The rack treated panels withstood 16 to 24 hours before the appearance of significant white corrosion. Barrel treated pieces showed the first appearance of white corrosion at 8 to 16 hours.

EXAMPLE 5

An aqueous acidic operating solution adapted for high-speed treatment of work pieces is prepared by forming an aqueous solution containing 10 percent by volume of Concentrate A and with varying amounts of Concentrate B ranging from about 3 up to about 10 percent by volume. When 3 percent of Concentrate B was used, the operating bath had a $NO_3$:metal ion mol ratio of about 4.6:1. When 10 percent of Concentrate B was used, the operating bath had a $NO_3$:metal ion mol ratio of about 11.8:1. The adjustment of pH to various levels is made by the addition of nitric acid.

Bright acid sulfate zinc plated steel test panels of a size 4 inches by 6 inches were treated with the passivating solutions under controlled different pH conditions, treatment times, and varying amounts of Concentrate B. The tests were conducted under conditions simulating the travel of zinc plated coil stock or zinc plated strip stock through a solution tank at a linear speed of about 150 to about 200 feet per minute. This was achieved by employing a tank having a cell immersed therein incorporating a nozzle arrangement to effect a downward flow of solution at a rate of about 25 gallons per minute past a stationary panel supported within the cell. The treated test panels were subjected to the ASTM B-117 5 percent neutral salt spray test to the first sign of white corrosion and the results under the particular processing conditions and concentrations employed are set forth in Table 1.

TABLE 1

| pH | Treatment Time, Sec. | Conc. B Vol. % | Hours to First White Corrosion |
|---|---|---|---|
| 1.5 | 2–4 | 3 | 8–10 |

TABLE 1-continued

| pH | Treatment Time, Sec. | Conc. B Vol. % | Hours to First White Corrosion |
|---|---|---|---|
| 1.5 | 2–4 | 6–10 | 20–24 |
| 1.8–2.0 | 5–10 | 3 | 8–10 |
| 1.8–2.0 | 5–10 | 6–10 | 20–24 |

EXAMPLE 6

An operating solution is prepared by forming an aqueous solution containing 2 volume percent of Concentrate A and 3 volume percent of Concentrate B of Example 1 ($NO_3$:metal ion=16.7:1) and adjusting the pH to about 2 employing nitric acid. The operating bath was divided into four separate samples and varying amounts of iron ions in combination with 3 g/l of zinc ions were added to each sample to simulate an aged bath typical of a commercial bath contaminated with such zinc and iron ions after prolonged use. Acid zinc plated test panels were immersed in each sample bath for a period of about 20 seconds and the resultant passivate film was observed. Two of the bath samples incorporated the clarity agent Dequest 2010 and the results as set forth in Table 2 evidence the benefit attained employing this additive agent in the presence of relatively high levels of iron contamination.

TABLE 2

| Fe Ions, ppm | Zn Ions, g/l | Dequest g/l | Appearance |
|---|---|---|---|
| 25–50 | 3 | 0 | Acceptable blue |
| 25–50 | 3 | 0.1–0.4 | Acceptable blue |
| 150 | 3 | 0 | Hazy, Cloudy |
| 150 | 3 | 0.1–0.1 | Acceptable blue |

EXAMPLE 7

A dry powder concentrate is prepared containing 54 percent by weight chromium sulfate (Chrometan), 2 percent by weight of the wetting agent Alipal CO433, 3 percent by weight of the wetting agent Nekal BX78, 10 percent by weight citric acid, 20 percent by weight sodium metasilicate and 10 percent by weight nickel sulfate hexahydrate.

A working solution is prepared by dissolving 15 g/l of the dry concentrate in water in addition to 50 g/l of sodium nitrate. The working solution had a $NO_3$:metal ion mol ratio of about 18:1. The working solution is adjusted to a pH of about 1.7 to about 2 with nitric acid.

Test panels which were plated in an acid chloride zinc plating bath, water rinsed are thereafter contacted with the working solution by immersion employing hand agitation for a period of 15 to 20 seconds. The panels are subsequently water rinsed and hot air dried. An inspection of the test panels evidences the formation of a clear, blue passivate film on the zinc surface similar to that observed in connection with prior Examples 2, 3 and 4.

EXAMPLE 8

For comparative purposes, an aqueous solution was prepared in accordance with the teachings of U.S. Pat. No. 3,932,198 corresponding to Formula II in column 4, lines 65–68. The concentrate contained 225 g/l chromium nitrate, 157 g/l manganese nitrate and the balance water to make 1 liter. The concentrate as well as the subsequent working solution had a mol ratio of nitrate ions to metal ions of about 1.22. A working solution was prepared by adding 1 percent by volume of the concentrate to water.

Steel test panels were plated with zinc in accordance with the procedure as described in Example 2, were thereafter rinsed with water and immersed in the resulting passivate solution for 15 seconds at 31° C. in accordance with the teachings in Table IIa in column 12, line 43 of U.S. Pat. No. 3,932,198. The resultant test panels were water rinsed and hot air dried by a hand-held blow dryer. The resulting panel was of a very cloudy and hazy appearance and was commercially unacceptable. After standing for 24 hours, the test panels were subjected to a neutral 5 percent salt spray test pursuant to ASTM B-117-73. After only 4 hours of salt spray testing, the test panel exhibited about 100 percent white corrosion over its entire surface. The first appearance of white corrosion occurred substantially before the 4 hour test duration. These corrosion results evidence a complete failure in comparison to test panels prepared in accordance with the present invention.

EXAMPLE 9

As a further comparison of the present invention to the prior art teachings, an aqueous working solution was prepared in accordance with the teachings of U.S. Pat. No. 4,126,490 pursuant to Example 3 thereof. The working solution contained chromium nitrate at 10 g/l, aluminum potassium sulfate at 30 g/l, ammonium metavanadate at 2.25 g/l, hydrochloric acid at 5.1 g/l and the balance water. The working solution had a mol ratio of nitrate ions to the sum of chromium and aluminum ions of about 0.44:1.

Zinc plated steel test panels prepared in accordance with the procedure described in Example 2 hereof were immersed for a period of 10 seconds in the foregoing working solution at a temperature of 42° C. The test panels were rinsed and the passivate coating was observed to be hazy and cloudy and generally commercially unacceptable. Following a standing for 24 hours, the panels were subjected to the ASTM B-117-73 5 percent neutral salt spray test. After a period of only 4 hours, the test panels exhibited almost 100 percent white corrosion with the first signs of white corrosion appearing substantially before the completion of the 4 hour test.

While it will be apparent that the preferred embodiments of the invention disclosed are well calculated to fulfill the objects above stated, it will be appreciated that the invention is susceptible to modification, variation and change without departing from the proper scope or fair meaning of the subjoined claims.

What is claimed is:

1. An aqueous acidic peroxide-free solution for treating receptive metal substrates to impart a chromium passivate film thereon comprising chromium ions substantially all of which are present in the trivalent state, hydrogen ions to provide an acidic pH, at least one additional activating metal ion selected from the group consisting of iron, cobalt, nickel, molybdenum, manganese, aluminum, lanthanum, cerium, lanthanide mixtures as well as mixtures thereof present in an amount effective to activate the formation of the chromate passivate film, and nitrate ions as the essential oxidizing agent present in an amount to provide a mol ratio of nitrate ions to chromium ions and activating metal ions of at least about 4:1 and sufficient to activate the hydrated trivalent chromium to form a chromate film on the substrate.

2. The aqueous solution as defined in claim 1 in which the trivalent chromium ions are present in an amount of about 0.05 g/l up to saturation.

3. The aqueous solution as defined in claim 1 in which the trivalent chromium ions are present in an amount of about 0.2 to about 4 g/l.

4. The aqueous solution as defined in claim 1 in which the trivalent chromium ions are present in an amount of about 0.5 to about 2 g/l.

5. The aqueous solution as defined in claim 1 having a pH of about 1.2 to about 2.5.

6. The aqueous solution as defined in claim 1 having a pH of about 1.5 to about 1.8.

7. The aqueous solution as defined in claim 1 in which said nitrate ions are present in an amount to provide a mol ratio of nitrate ions to chromium ions and activating metal ions within a range of about 10:1 to about 40:1.

8. The aqueous solution as defined in claim 1 in which said nitrate ions are present in an amount to provide a mol ratio of nitrate ions to chromium ions and activating metal ions within a range of about 15:1 to about 30:1.

9. The aqueous solution as defined in claim 1 in which said one additional metal ion is present in an amount of about 0.02 to about 1 g/l.

10. The aqueous solution as defined in claim 1 in which said one additional metal ion is present in an amount of about 0.1 to about 0.2 g/l.

11. The aqueous solution as defined in claim 1 further including sulfate ions present in an amount up to about 15 g/l.

12. The aqueous solution as defined in claim 1 further including sulfate ions present in an amount of about 0.5 to about 5 g/l.

13. The aqueous solution as defined in claim 1 further including halide ions present in an amount up to about 2 g/l.

14. The aqueous solution as defined in claim 1 further including halide ions present in an amount of about 0.1 to about 0.5 g/l.

15. The aqueous solution as defined in claim 1 further including an organic carboxylic acid present in an amount up to about 4 g/l.

16. The aqueous solution as defined in claim 1 further including a bath soluble and compatible silicate compound present in an amount up to about 5 g/l calculated as $SiO_2$.

17. The aqueous solution as defined in claim 1 further including at least one bath soluble and compatible wetting agent present in an amount up to about 1 g/l.

18. The aqueous solution as defined in claim 1 further including at least one bath soluble and compatible wetting agent present in an amount of about 50 to about 100 mg/l.

19. A process for treating a receptive metal substrate to impart a chromate passivate film thereon which comprises the steps of contacting the substrate with an aqueous acidic peroxide-free solution at a temperature of from about 40° to about 150° F. having a composition as defined in claim 1 for a period of time sufficient to form a passivate film thereon.

20. The process as defined in claim 19 including the further step of controlling the temperature of said solution within a range of about 70° to about 90° F.

* * * * *